United States Patent [19]

Shinkai et al.

[11] Patent Number: 5,000,022

[45] Date of Patent: Mar. 19, 1991

[54] PRESSWORK MACHINERY

[75] Inventors: Itaru Shinkai, Okazaki; Hisayoshi Fukushima, Toyota, both of Japan

[73] Assignee: Mitsubishi Jidosha Kogyo Kabushiki Kaisha, Tokyo, Japan

[21] Appl. No.: 367,725

[22] Filed: Jun. 16, 1989

[30] Foreign Application Priority Data

Jun. 29, 1988 [JP] Japan ..... 63-159192
Jun. 29, 1988 [JP] Japan ..... 63-159193

[51] Int. Cl.[5] ..... B21D 37/04

[52] U.S. Cl. ..... 72/21; 72/446; 72/448; 72/481

[58] Field of Search ..... 72/21, 446, 448, 462, 72/481; 100/214

[56] References Cited

U.S. PATENT DOCUMENTS

| | | | |
|---|---|---|---|
| 3,422,662 | 1/1969 | Geuss | 72/448 |
| 3,881,343 | 5/1975 | Ducate | 72/481 |
| 4,598,574 | 7/1986 | Hegel et al. | 72/462 |
| 4,665,733 | 5/1987 | Wallis | 72/481 |
| 4,674,315 | 6/1987 | Linz | 72/481 |
| 4,698,894 | 10/1987 | Lingaraju et al. | 72/481 |

FOREIGN PATENT DOCUMENTS

| | | | |
|---|---|---|---|
| 0103237 | 8/1980 | Japan | 72/448 |
| 0120432 | 9/1980 | Japan | 72/481 |
| 2158753 | 11/1985 | United Kingdom | 72/481 |

OTHER PUBLICATIONS

"Technique of Pressworking Sheet Metal", Eary and Reed, 1974, pp. 440, 473, 475, 476.

*Primary Examiner*—David Jones
*Attorney, Agent, or Firm*—Abelman Frayne Rezac & Schwab

[57] ABSTRACT

A presswork machine having location pins protruding from the upper of the bolster, of which the top ends are engageable with location holes provided on the bottom of the press die, thereby enabling easy and exact positioning of the press die to the bolster, and having a fixing device provided on the presswork machine side to fix the press die to the bolster, thereby simplifying the structure of the bolster and reducing the equipment cost.

6 Claims, 7 Drawing Sheets

FIG.3
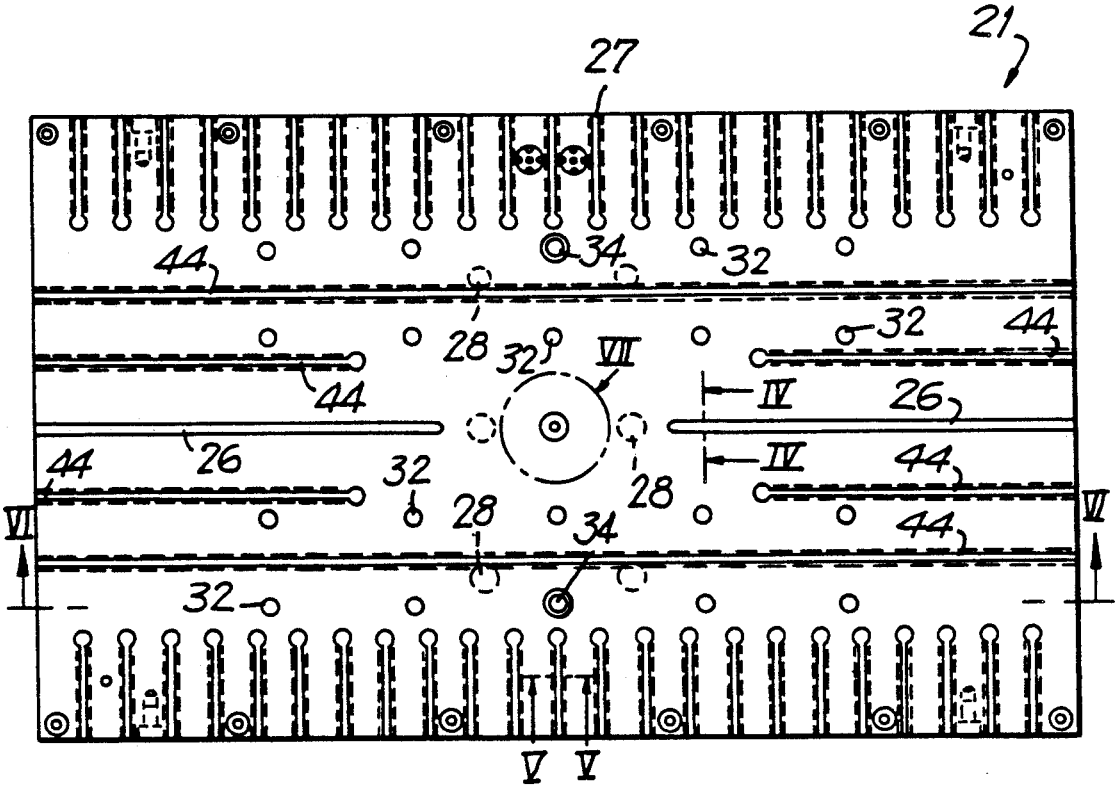
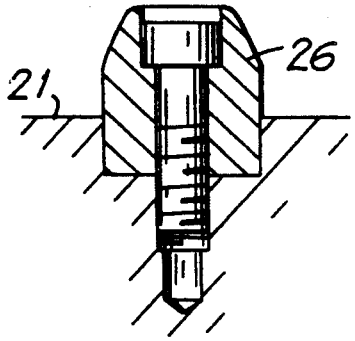
FIG.4
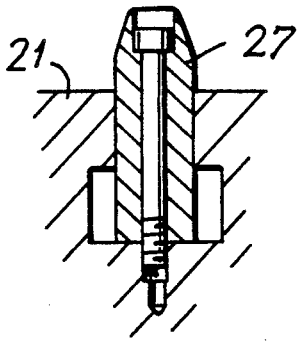
FIG.5

21
22
52
24
26
32
38a
23
39
36
37
29
28
35
33
34
38
27
25
30
31

FIG.7
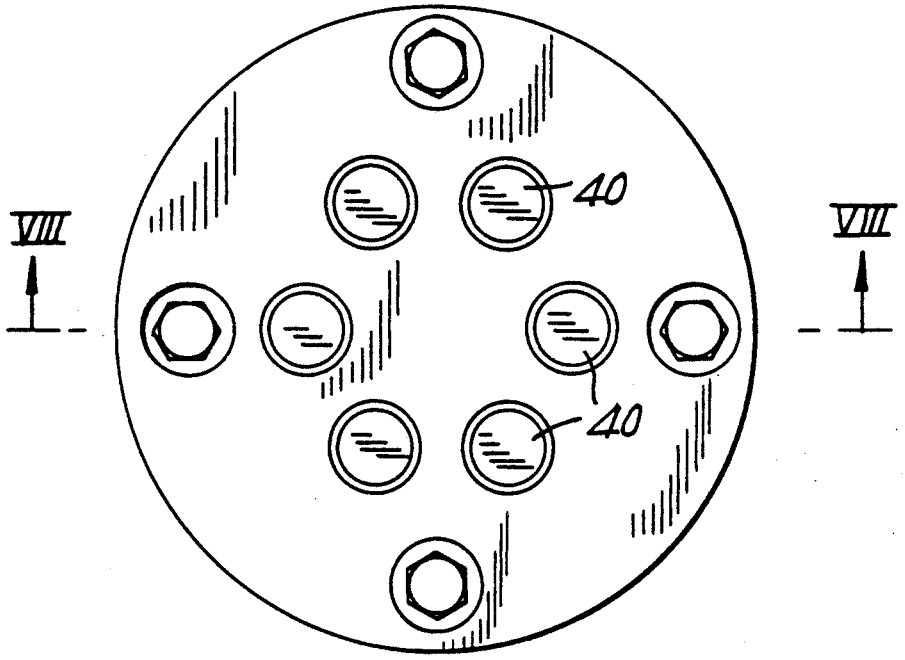
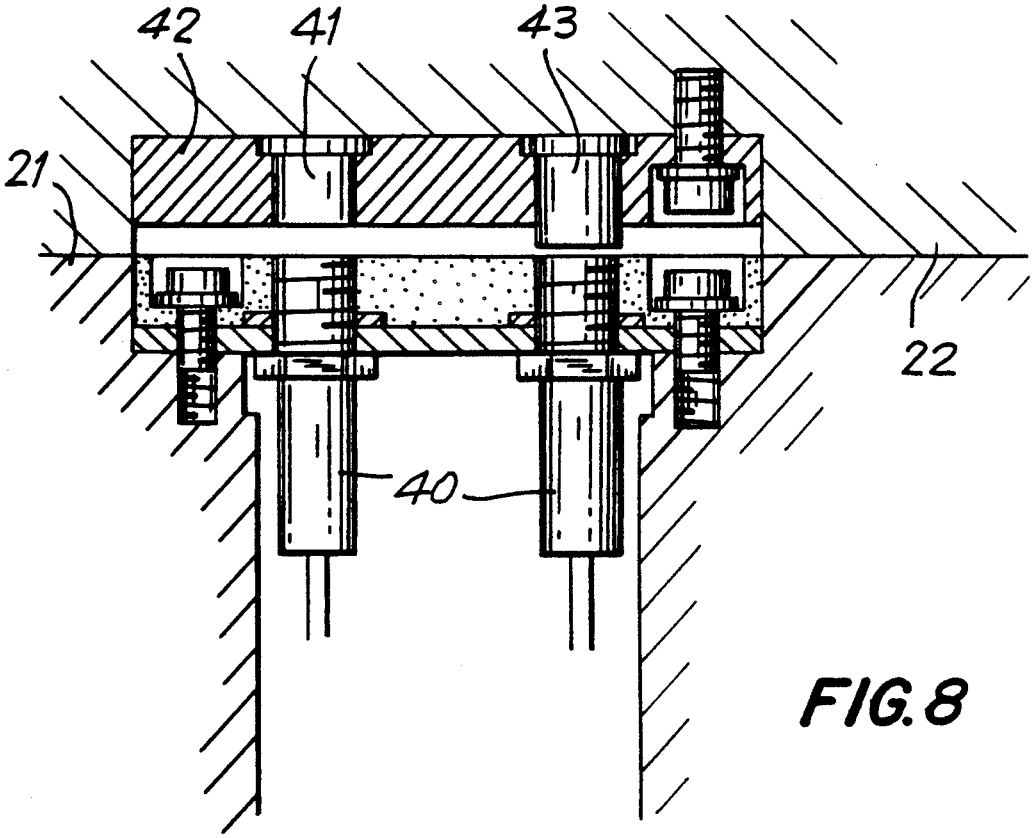
FIG.8

PRESSWORK MACHINERY

BACKGROUND OF THE INVENTION

This invention relates to a presswork machine equipped with a detachable bolster and a press die positioning device for positioning and fixing a press die onto the bolster.

A body of an automobile, particularly a monocoque body is formed by welding and joining a large number of body panels. Normally, these body panels are produced from a strip unwound from a coil, which is cut into blanking panels of shapes corresponding to body panels, and the blanking panels are then processed by a transfer press line into the body panels of specified shapes.

As well known, in the press work, the time required for the replacement of press dies is one of the factors that largely affect the operation rate of the pressing facility. Therefore, in view of the adaptability of the press line to the automobile assembly line, it is necessary to process several hundred to several thousand blanking panels using a pair of press dies, the processing work is sequentially carried out for all press dies, and the finished body panels are temporarily stored in a stockyard, which are supplied as needed to the assembly line. Similarly, when the coil is cut into the blanking panels, the coil is punched into several hundred to several thousand blanking panels using a pair of press dies and, while this work is sequentially carried out for all press dies, these blanking panels are continuously supplied to the transfer line.

Currently, only part of handling work of press dies for presswork machines is automated. Handling of press dies between the bolsters for the presswork machines and the press die stockyard is inevitably performed by hanging work using an overhead-travelling crane or the like, because of heavy weight of the press dies.

To attempt automation of a series of press work according to the car production program, it is necessary to abolish handling of press dies by hanging work, and handling of press dies between the bolsters for the presswork machines and the press die stockyard be performed by a stacker crane or the like. In this connection, it is also necessary to facilitate positioning of press dies with respect to the bolsters.

To prevent lowering of operation rate of the presswork machine associated with replacement of press dies, it is desirable to use a pair of bolsters, and replacement of press dies be performed to the bolster which is in the standby state at the side of the presswork machine.

However, prior art bolsters have a device for clamping the lower press die (Japanese Utility Model Laid-open No. 61-133228/1986, Japanese Utility Model Laid-open No. 61-205624/1986). Since such bolsters are loaded in alternation on the presswork machine, various pipes become complex in structure, which leads to increased equipment cost. Since, in the prior art, press dies are placed directly on the top of the bolster, there is no room for inserting a fork of a stacker crane or the like between the bolster and the press dies, making it impossible to automate the handling work of press dies.

OBJECT OF THE INVENTION

With a view to obviate the above prior defects of presswork machines, it is a primary object of the present invention to provide a presswork machine which is equipped with a press die positioning device that enables easy and precise positioning of press dies with respect to the bolster, without a substantial increase in equipment cost.

SUMMARY OF THE INVENTION

In accordance with the present invention which attains the above object, there is provided a press die positioning device comprising a bolster detachably mounted onto a presswork machine and detachably mounted with a press die, a plurality of location pins protruding from the upper of said bolster by the action of a pin lifting device incorporated in said bolster and having top ends engageable with location holes formed in the bottom of said press die, and a fixing device disposed on the side of said presswork machine for fixing said press die to said bolster, said fixing device having sliders guided by slider guides respectively formed on said presswork machine and on the upper of said bolster to transfer from said presswork machine to said bolster by the action of a slider driving device, whereby said press die is fixed to said bolster, and a clamping device provided on said slider and capable of fixing said press die to the upper of said bolster.

When placing the press die on the bolster, the press die is moved down so that the location pins protruding from the upper of the bolster are aligned with the location holes formed in the bottom of the press die. In the course of the moving down, the location pins are inserted into the location holes to determine the position of the press die relative to the bolster.

The bolster, together with the press die, is then fed into the presswork machine, the slider of the fixing device is operated to transfer the slider onto the slider guide of the bolster, and the press die is fixed to the bolster by the clamping device.

BRIEF DESCRIPTION OF THE DRAWINGS

FIG. 1 is a schematic view showing an embodiment of the press die positioning device according to the present invention which is applied to the production line of a blanking panel of an automobile.

FIG. 3 is a schematic plan view of a bolster.

FIG. 4 is a schematic cross sectional view taken along line IV—IV in FIG. 3.

FIG. 5 is a schematic cross sectional view taken along line V—V in FIG. 3.

FIG. 7 is a schematic enlarged cross sectional view taken along line VII—VII in FIG. 3.

FIG. 8 is a schematic cross sectional view with a press die mounted, taken along line VIII—VIII in FIG. 7.

DETAILED DESCRIPTION OF THE PREFERRED EMBODIMENT

Figure 11:
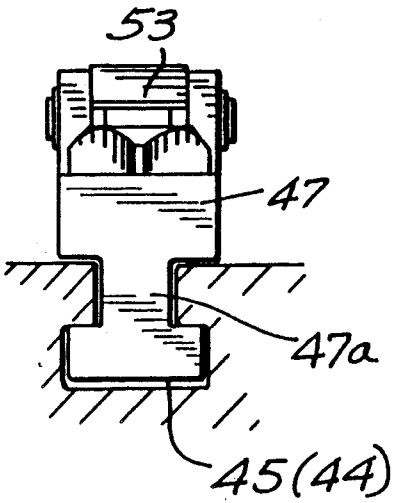
FIG. 11 is a schematic side view of the fixing device.

FIG. 1 is a schematic view showing an embodiment of the presswork machine according to the present invention when applied to a production line of an automobile blanking panel.

A strip 46 unwound from a coil 11 is passed through a cleaning device 12, and then leveled by a leveler 13 to remove residual stress. Then the strip 46 is fed by a feeder 15 from a loop pit 14 to a presswork machine 16, where it is cut into blanking panels 17 of a predetermined shape, which are fed by conveyers 18 and 19 to be stacked on pilers 20.

Figure 2:
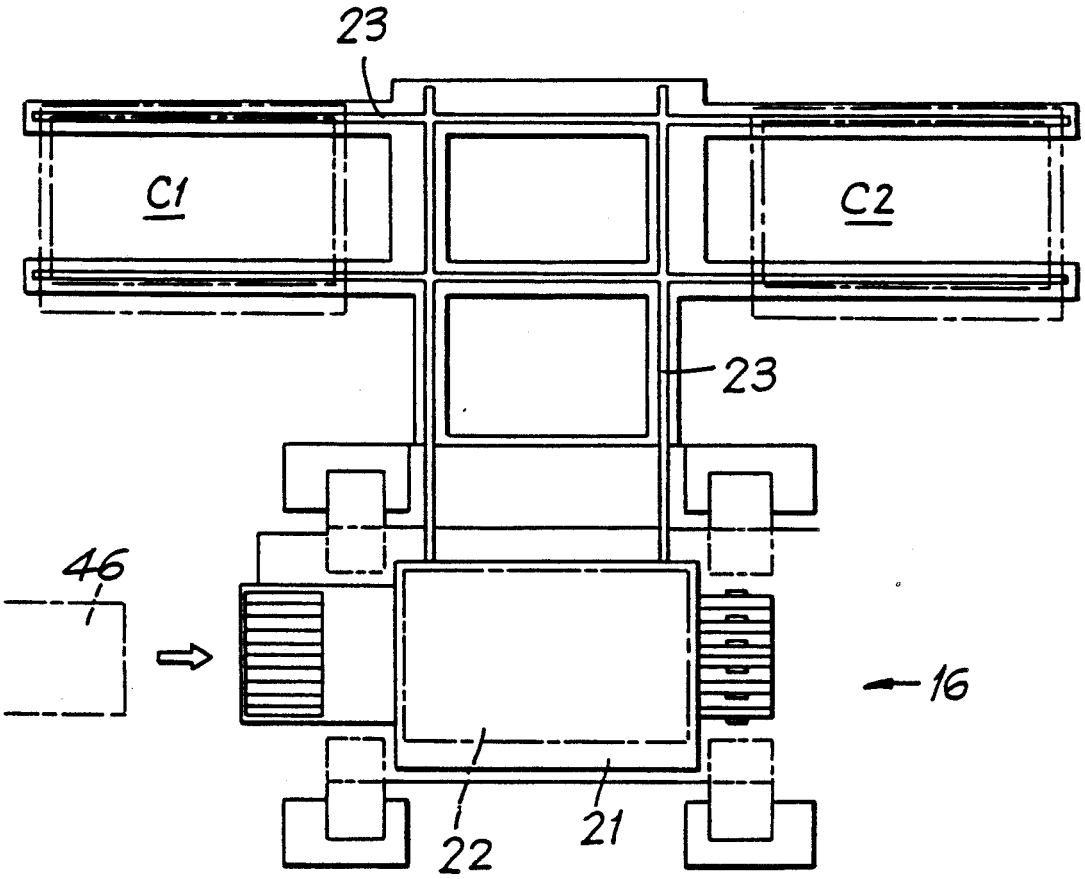
FIG. 2 is a schematic plan view of part of a presswork machine.

As shown in FIG. 2 which is a schematic plan view showing part of the presswork machine 16, in this embodiment the presswork machine 16 is provided with a set of two bolsters 21 which are detachably mounted in alternation. Loading of upper and lower dies on each bolster 21 is performed at die replacement positions $C_1$ and $C_2$ located on a pair of guide rails 23 connected to the presswork machine 16.

Thus, when one bolster 21 is mounted on the presswork machine 16, the other bolster 21 is located at either the die replacement position $C_1$ or $C_2$. When a used press die 22 is removed, the next press die is mounted and the machine enters the stand-by state. When the press work using the press dies 22 incorporated in the presswork machine 16 is completed, the upper and lower press dies 22 together with the bolster 21 are fed out from the presswork machine 16, moved along the guide rails 23 and stopped at unoccupied one of the die replacement positions $C_1$ and $C_2$. Then, the bolster 21 in stand-by is moved with its press dies 22 along the guide rails 23 into the presswork machine 16, where press work is done with the newly replaced press dies 22. At the same time, replacement of the coil 11 and/or the piler 20 is performed as needed.

Figure 6:
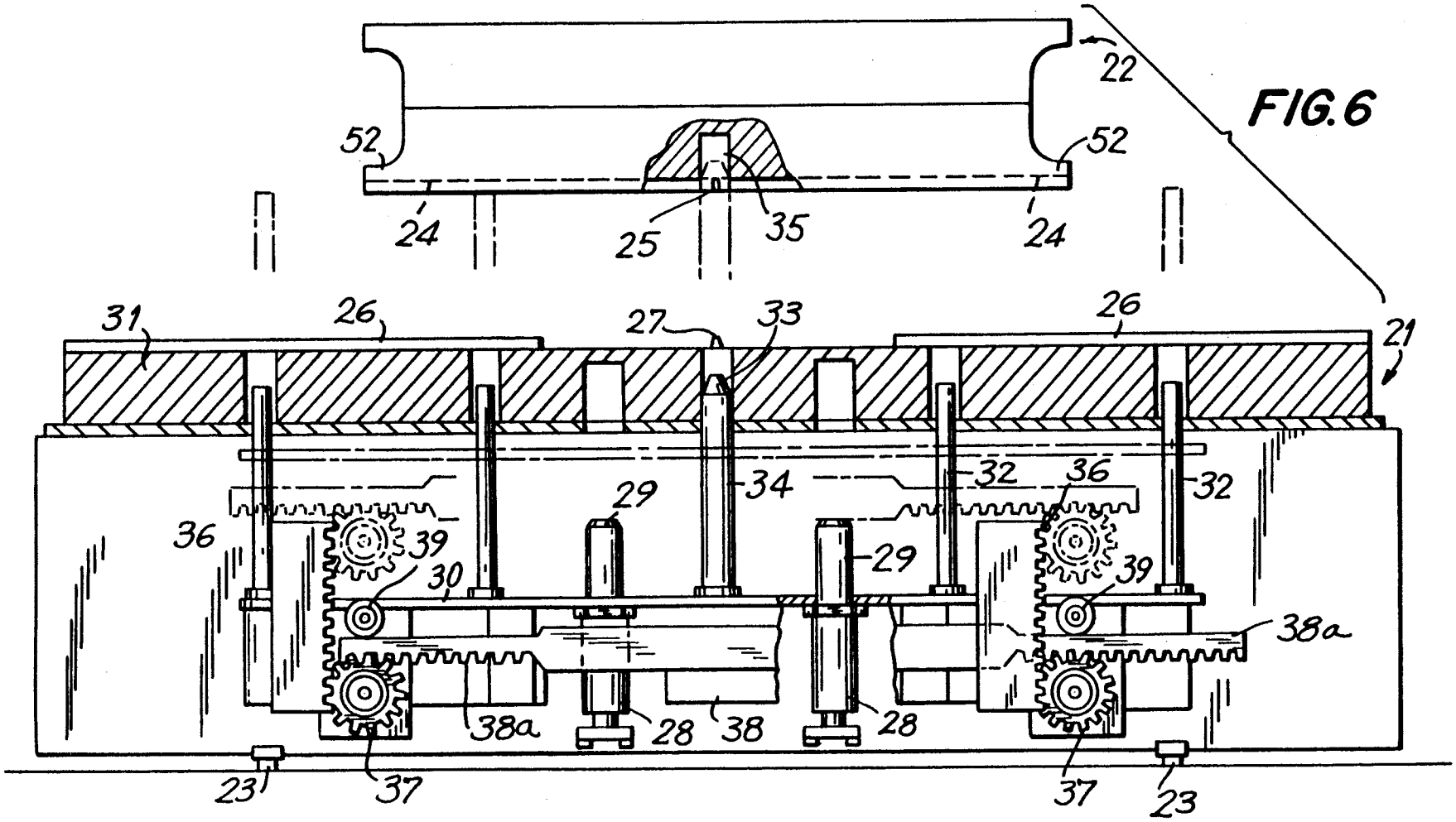
FIG. 6 is a schematic enlarged cross sectional view taken along line VI—VI in FIG. 3.

As shown in FIG. 3 which is a schematic enlarged plan view of the bolster 21 and in FIG. 4, 5, and 6 which are schematic cross sectional views of the bolster 21 taken along lines IV—IV, V—V, VI—VI, respectively, on the upper of the bolster 21 are perpendicularly protruded a pair of engaging projections 26 and 27, which are engageable with a pair of positioning grooves 24 and 25 formed on the bottom of the press die 22. All of the press dies 22 are placed on the bolster 21 with the the engaging projections 26 and 27 engaged with the positioning grooved 24 and 25. In these bolsters 21 are provided a plurality (6 in this embodiment) of hydraulic cylinders, and a pin holding plate 30 is integrally fixed to plungers 29. The pin holding plate 30 is provided, protruding from its surface, with a plurality (18 in this embodiment) of lifter pins 32 penetrating an upper plate 31 of the bolster 21 and a plurality (2 in this embodiment) of location pins 34 having conical tapered end portions 33. As the plungers 29 move up, these end portions protrude from the upper of the bolster 21. The bottom of each bolster 21 is provided with two location holes 35 which engage with the end portions of the location pins 34 to achieve rough positioning of the press die 22 with respect to the bolster 21, thereby facilitating engagement of the positioning grooves 24 and 25 with the engaging projections 26 and 27. The lifter pins 32 come in contact against the bottom of the press die 22 to lift the press die from the upper of the bolster 21, thereby making a space between the bolster 21 and the press die 22 which allows insertion of a fork of a stacker crane (not shown) or the like. For this purpose, in this embodiment, the protrusion length of the location pins 34 is greater than the protrusion length of the lifter pins 32 from the pin holding plate 30, thereby enabling automation of the press line without using hanging work.

At the die replacement positions $C_1$ and $C_2$, the hydraulic cylinders 28 of the bolster 21 which is vacant operate to move the pin holding plate 30 up to its ascending end, causing the lifter pins 32 and the location pins 34 to project from the upper of the bolster 21. With this condition, the press die 22 is carried in from a stockyard (not shown) using a stacker crane or the like, and the press die 22 is placed on the lifter pins 32 so that the location holes 35 of the press die 22 are in line with the tapered portions 33 of the location pins 34 (indicated by two-dot-bar lines in FIG. 6). Then, the hydraulic cylinders 28 are operated again to move the pin holding plate 30 down to its descending end. Associated with the descending movement of the pin holding plate 30, the press die 22 is also moved down together with the lifter pins 32 and the like, and finally placed on the upper of the bolster 21. At this time, the positioning grooves 24 and 25 of the press die 22 engage with the engaging projections 26 and 27, respectively, on the upper of the bolster 21, thereby achieving exact positioning of the press die 22 with respect to the bolster 21.

In this embodiment, to assure the pin holding plate 30 to parallelly move up and down without inclining, the bolster 21 is provided with pinions 37 rotatably disposed at its four corners, which engage with rack plates fixed respectively to the four corners. Furthermore, there are provided two timing bars 38 forming racks **38*a*, of which both ends engage with respective pair of these pinions 37, disposed movably in the right and left directions in FIG. 6. The number of teeth and modules of the pinions 37 are all set equally. Thus, as the pin holding plate 30 moves up and down, the pinions 37 make turns relative to the rack plates 36. As a result, the timing bars 38 move right and left in FIG. 6 to synchronize the pair of the pinions 37, and the pin holding plate 30** is moved horizontally without inclining.

As shown in FIG. 7 which is a schematic enlarged view of the VII—VII portion in FIG. 3, and FIG. 8 which is a schematic cross sectional view taken along line VIII—VIII in FIG. 7, each of the bolsters 21 is provided, at its center, with a plurality (6 in this embodiment) of proximity switches 40 which are exposed on the upper of the bolster 21 and embedded circularly with equal intervals. A dog mounting plate 42 having a plurality of dog mounting holes 41 corresponding to the proximity switches 40 is fastened with bolts at the center of the bottom of each press die 22. The dog mounting holes 41 are provided with 1 to 6 dogs 43 at positions predetermined corresponding to the type of the press die 22. The proximity switches 40 are connected with judging means (not shown) which detects the type of the press die 22 placed on the upper of the bolster 21 and determines whether or not it is of the predetermined type. Thus, even if by some mistake a press die 22 which is not of the predetermined type is carried in and placed in position on the bolster 21, the judging means determines from the arrangement of the dogs 43 through the proximity switches 40 that the press die 22 is not of the predetermined type, and causes a warning device (not shown) to output a warning sound or a warning lamp to light so that the press die 22 of the correct type be carried in using a stacker crane, or the press line be stopped as needed.

Figure 10:
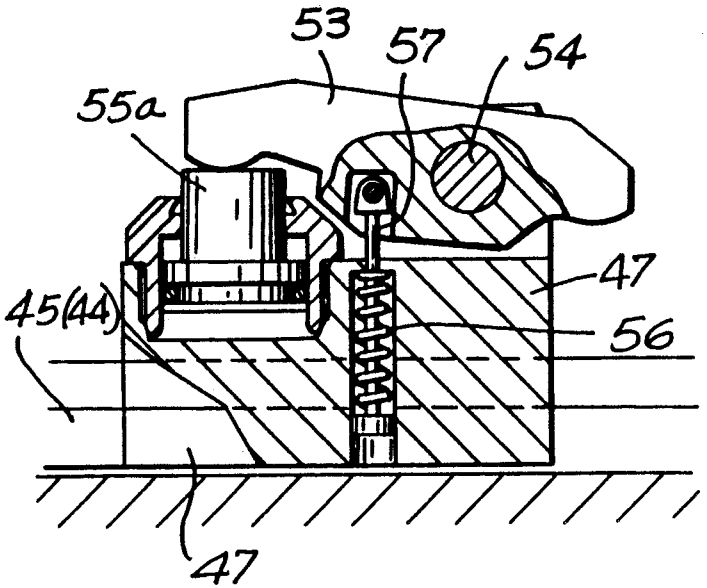
FIG. 10 is a schematic view showing part of the fixing device.
Figure 9:
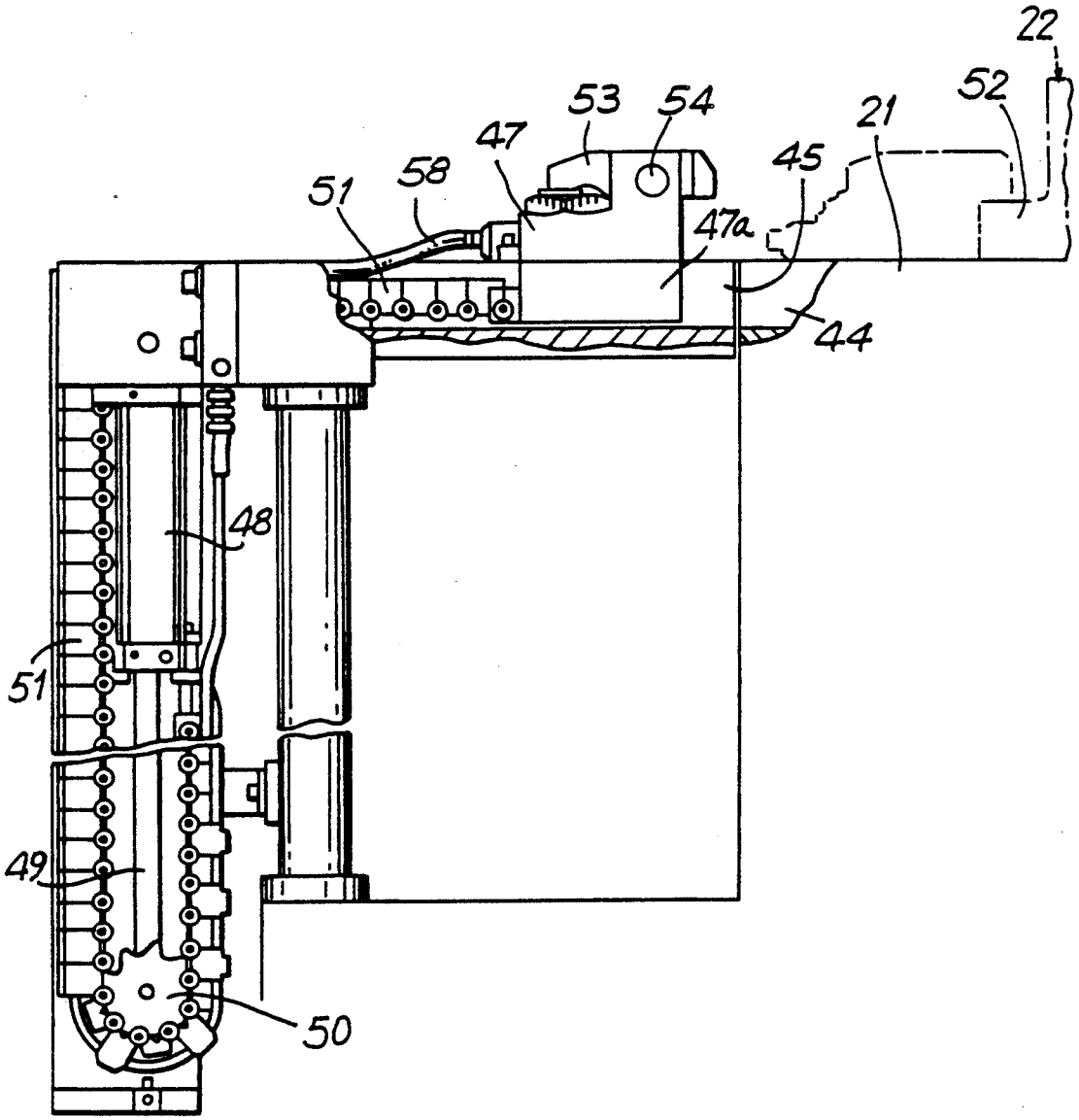
FIG. 9 is a schematic view of a fixing device for a lower press die.
Figure 11:
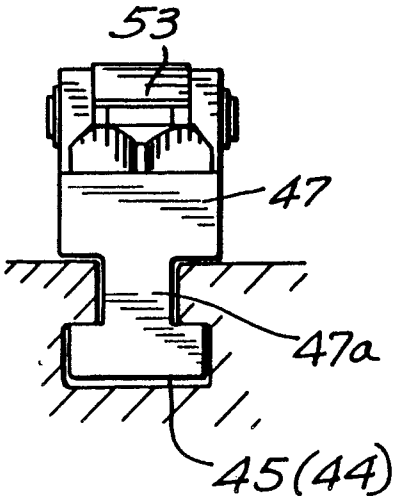
Figure 10:
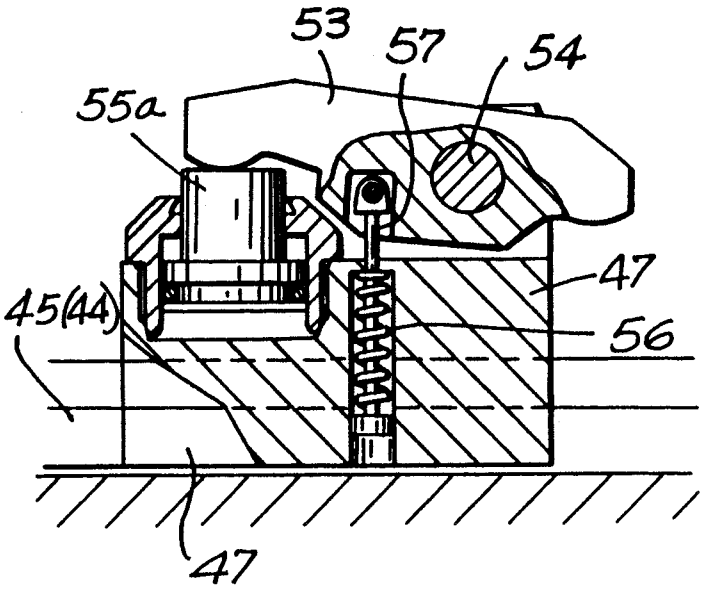

When the press die 22 placed on the bolster 21 is of the predetermined type, in the presswork machine 16, the lower press die 22 is fixed to the bolster 22. The upper press die 22 is fixed to the punch side of the presswork machine 16. Fixing means for fixing the upper die to the presswork machine 16 is the same as used in the prior art. However, this embodiment differs from the prior art in that fixing means for the lower die is provided on the presswork machine 16 side. As shown in FIG. 9 which is a schematic view showing the lower die fixing means, FIG. 10 showing a broken view of part of the lower die fixing means, and FIG. 11 and FIG. 3 which are left side views of the fixing means, on the upper of each bolster 21 positioned in the presswork machine 16 using a means known in the art are provided a plurality (6 in this embodiment) of T slots 44 extending in the right and left directions. Corresponding to the T slots 44, on the presswork machine 16 side are formed four each of T slots 45, which are in line with the T slots 44, at the upstream and downstream sides of the path of the strip 46 unwound from the coil 11. These T slots 45 are slidably engaged with sliding engagement portions 47*a* formed on the lower ends of sliders 47. Each of the sliders 47 is connected with one end of a chain block 51 which is always engaged with a sprocket 50 rotatably mounted on the end of a piston rod 49 of the hydraulic cylinder 48. The other end of the piston rod 51 is fixed to the presswork machine 16 side. According to the movement of the piston rod 49, one end of the chain block 51 is pushed out to the right or reverted back to the left. According to the action of the chain block 51, the slider 47 is transferred from the T slot 45 to the T slot 44. Each of the sliders 47 is provided with a locking claw 53, mounted through a pin 54, which with its front end holds a flange 52 formed on the lower press die 22. The rear end of the locking claw 53 contacts against the upper of a plunger 55*a* of a jack 55 mounted on the slider 47. Between the locking claw 53 and the slider 47 is provided a rod 57 having a compression coil spring 56 to urge the rear end of the locking claw 53 to the jack 55 side. The jack 55 is connected to a hydraulic oil pipe 58 disposed along the chain block 51. The locking claw 53 is turned according to the supply of hydraulic oil to the jack 55.

When the bolster 21 is fixed in position in the presswork machine 16, the slider 47, which has been in the stand-by state in the T slot 45, is transferred to the T slot 44 side by the action of the hydraulic cylinder 48 and comes in contact against the flange 52 of the press die 22 on the bolster 21, where it is stopped. Then, the jack 55 operates to cause the locking claw 53 to press the flange 52 against the bolster 21. After that, the strip 46 is fed into the presswork machine 16 and press work is started.

The positions of the location pins 34 are not restricted to those used in this embodiment, but may be located at other positions with no problems. The fixing device may also be of other configuration which is provided on the presswork machine 16 side and is able to transfer onto the bolster 21. The positioning means for the press die 22 to the bolster 21 is not restricted to this embodiment, but other known means may also be used without problems.

What is claimed is:

1. A presswork machine, comprising in combination:

a bed of said presswork machine;

a bolster, and means for detachably mounting said bolster on said bed of said presswork machine;

a plurality of locating pins slidably supported by said bolster and moveable between a first position in which said pins are retracted within said bolster, and a second position in which ends of said pins extend above an upper surface of said bolster;

power driven means for moving said pins between said first and second positions;

a plurality of lifter pins slidably supported by said bolster and moveable between a first position in which said lifter pins are retracted within said bolster, and a second position in which said lifter pins engage and lift a said press die;

power driven means for moving said lifter pins between said first and second positions;

means for securing a press die to said bolster;

said securing means including clamping devices mounted on said press machine at sides of said bolster;

said clamping devices including slider members moveable longitudinally within longitudinally aligned guides respectively formed on said press machine and an upper surface of said bolster, said slider members being moveable within said guides from a first position in which they are supported by said press machine to a second position in which said slider members are supported by said bolster;

means for moving said slider members between said first and second positions; and, means carried by each said slider member for clamping engagement with a press die positioned on said bolster in order to clamp said press die to said bolster.

2. The press machine of claim 1, including:

a plate contained within said bolster, said plate rigidly supporting said locating pins and said lifter pins;

hydraulic cylinders contained within said bolster, said hydraulic cylinders having plungers supporting said plate for movement of said pins between said first and second positions;

timing bars supported by said plate for movement in a direction transverse to the direction of movement of said plate under the control of said hydraulic cylinders;

a rack formed at each end of each said timing bar;

pinions rotatably supported on said plate and respectively meshed with said racks on said timing bars; and, rack plates fixedly secured in said bolster and respectively meshed with said pinions.

3. The press machine of claim 1, in which said longitudinally aligned guides in said press machine and said bolster are each axially straight slots of inverted T-shaped cross-section, and said slider members are of a cross-section complimentary to that of said slots.

4. The press machine of claim 1, in which means for moving said slider members axially of said slots includes a chain block secured at its respective ends to an associated said slider and to said press work machine, and which is entrained about a sprocket, said sprocket being rotatably supported on a plunger of a hydraulic ram secured to said press machine.

5. The press machine of claim 1, in which said clamping means each include;

a clamping member pivotally mounted on an associated said slider member and having an end portion for clamping engagement with said press die;

a hydraulic jack incorporated into said associated slider and having a plunger for moving said clamping member into clamping engagement with said press die under the influence of hydraulic pressure; and, a spring reacting between said associated slider member and said clamping member for releasing said clamping member from clamping engagement with said press die upon deactivation of said hydraulic jack.

6. The presswork machine of claim 1, including a plurality of proximity switches incorporated into an upper surface of said bolster, said proximity switches being operative to detect an arrangement of dogs incorporated into a bottom surface of said press die, and which are indicative of the type of the press die.

* * * * *